US005447242A

United States Patent [19]

Kelly et al.

[11] Patent Number: 5,447,242

[45] Date of Patent: Sep. 5, 1995

[54] TALL BOOK DISPLAY RACK

[75] Inventors: Ray G. Kelly; Sharon A. Turnbough, both of County of St. Louis; Douglas Blocker, County of Jefferson, all of Mo.

[73] Assignee: Angeles Group, Inc., Pacific, Mo.

[21] Appl. No.: 190,621

[22] Filed: Jan. 31, 1994

Related U.S. Application Data

[63] Continuation-in-part of Ser. No. 18,181, Jan. 31, 1994.

[51] Int. Cl.[6] ..... A47F 5/00

[52] U.S. Cl. ..... 211/42; 211/55; 211/128; D6/476

[58] Field of Search ..... 211/42, 45, 55, 50, 211/128; D6/474, 475, 476, 449

[56] References Cited

U.S. PATENT DOCUMENTS

| | | | |
|---|---|---|---|
| D. 55,077 | 5/1920 | Page . | |
| D. 145,835 | 10/1946 | Chase . | |
| D. 194,008 | 11/1962 | Bishop . | |
| 282,989 | 3/1886 | Nelson . | |
| 306,040 | 2/1890 | Evenson . | |
| D. 340,156 | 10/1993 | Bonazza et al. | D6/476 |
| D. 348,366 | 7/1994 | Stavitz | D6/476 |
| 2,368,909 | 2/1945 | Wright | 211/128 |
| 3,179,479 | 4/1965 | Freedman . | |
| 3,198,340 | 8/1965 | Tokash | 211/55 X |
| 3,777,897 | 12/1973 | Gray | 211/128 X |
| 5,009,335 | 4/1991 | Jonker | 211/55 |
| 5,040,688 | 8/1991 | Martin et al. | 211/55 |
| 5,086,934 | 2/1992 | Kelly | 211/45 |

FOREIGN PATENT DOCUMENTS 2187587 9/1987 United Kingdom .

OTHER PUBLICATIONS

Ad page 205 from Lozier Store Fixture catalog.
Ad page 722 from Lozier Store Fixtures catalog.

*Primary Examiner*—Robert W. Gibson, Jr.
*Attorney, Agent, or Firm*—Paul M. Denk

[57] ABSTRACT

A book rack has two side walls and a rack extending between the side walls. The side walls each include a core made of a lightweight structural material, such as corrugated or honeycombed paperboard, a coating which coverers inner and outer surfaces of the core, and an edge bead covering an edge of the core. The rack comprises a single sheet of substantially transparent material formed generally as a wave defining a plurality of valleys. Each valley has a forward wall and a rear wall. The sheet is formed such that the a valley is positioned above and behind a preceding valley so that the books which are placed in the valleys will be easily visible.

17 Claims, 2 Drawing Sheets

TALL BOOK DISPLAY RACK

CONTINUING APPLICATION DATA

This is a continuation-in-part of design application having Ser. No. 29/018/181, filed on Jan. 31, 1994.

BACKGROUND OF THE INVENTION

This invention relates to book racks, and, in particular, book or display racks made of lightweight materials.

Book racks are found in many places, including nurseries. Books found in nurseries typically are tall and have colorful colors. Unlike novels, books meant for toddlers are thin. Thus, book racks for nurseries must be designed to display the front, rather than the side, of the book, so that the toddlers can recognize the books. Further, the book rack should make as much as possible of the book cover visible.

SUMMARY OF THE INVENTION

One object of the present invention is to provide a book rack for use in nurseries.

Another object is to provide such a book rack which will display the cover of the books contained therein.

Another object is to provide such a book rack which will display as much as possible of the book cover.

Another object is to provide such a book rack which may readily be used by toddlers.

These and other objects will be come apparent to those skilled in the art in light of the following disclosure and accompanying drawings.

In accordance with the invention, generally stated, a book rack for use in nurseries is provided. The book rack has two side walls and a rack extending between the side walls. The side walls each include a core made of a lightweight structural material, coatings covering inner and outer surfaces of the core, and an edge bead covering an edge of the core. The material which makes up the core is preferably styrofoam, foamed urethane, corrugated paperboard, or honeycombed paperboard. Other light weight materials could also be used. The coating is preferably a formica coating, but again, other materials, such as plastics, which are easily washable can also be used.

The rack means is made of a single sheet of material formed generally as a wave defining a plurality of valleys in which books can be placed. The book rack is intended for use in a nursery, and thus the valleys can be narrow, so that the face of the books, rather than the spines, will be visible. Each valley has a forward wall and a rear wall. The sheet is formed such that the a valley is positioned above and behind a preceding valley. The sheet which makes up the rack is preferably clear or substantially transparent. It may be made of a polymer, such as a plastic or acrylic. The side walls have grooves formed therein in which the rack is received. Preferably, the rack is glued into, or otherwise secured in, the grooves. The rack will then be the only piece holding the two side walls together.

The side wall coverings preferably extend beyond the core to define a channel. The edge bead includes a foot portion and an exposed bead portion. The foot portion is received in the channel, for example, by a force fit. The edge bead may be made of extruded plastic or rubber. It is preferably hollow and has an inner wall separating the foot portion from the bead portion.

DESCRIPTION OF THE PREFERRED EMBODIMENT

Figure 1:
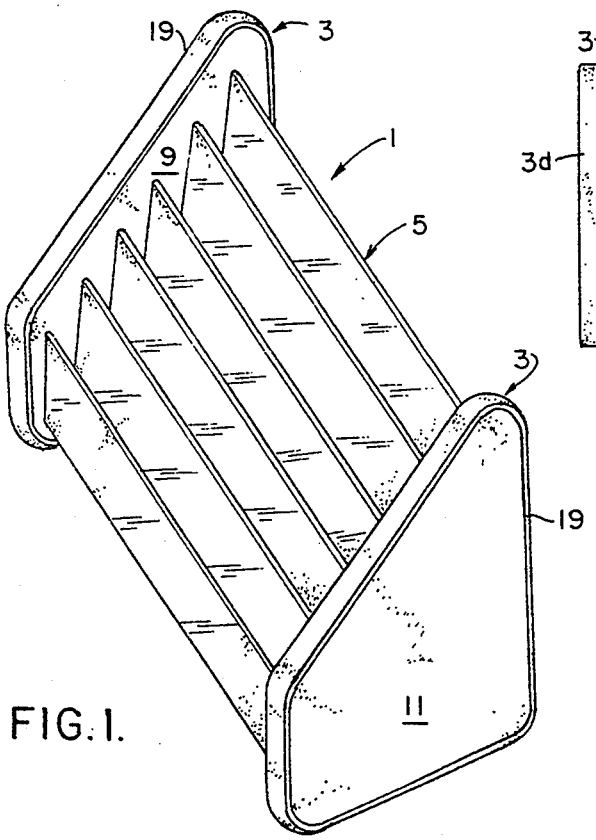
FIG. 1 is a perspective view of a book rack of the present invention.
Figure 2:
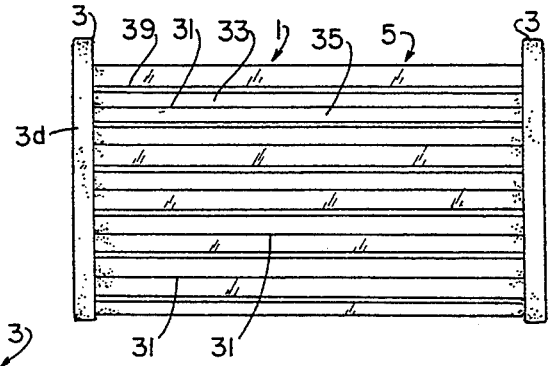
FIG. 2 is a top plan view of the book rack.
Figure 3:
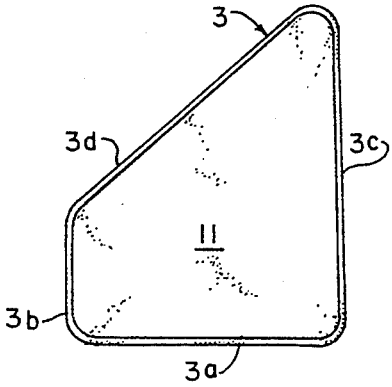
FIG. 3 is a side elevational view of the book rack.
Figure 4:
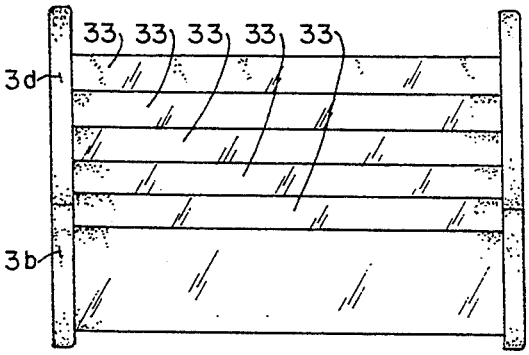
FIG. 4 is a front elevational view of the book rack.
Figure 6:
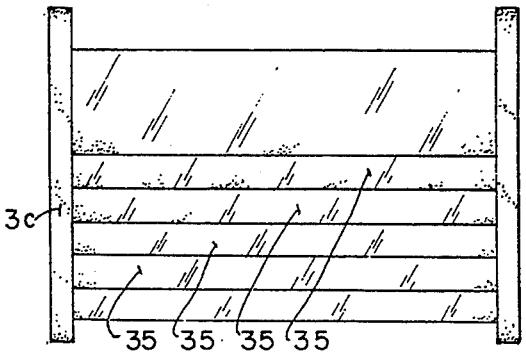
FIG. 6 is a rear elevational view of the book rack.
Figure 5:
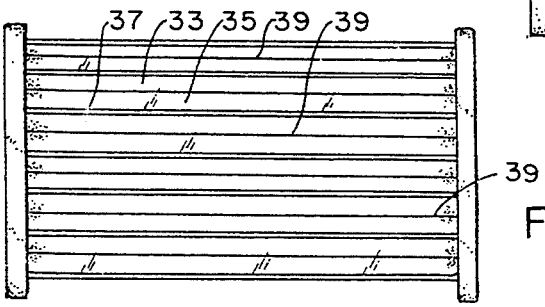
FIG. 5 is a bottom plan view of the book rack.
Figure 7:
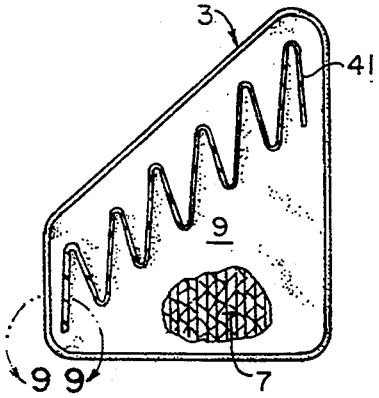
FIG. 7 is a side elevational view of a side wall of the book rack, partly broken away to show the construction of the side wall.

Referring now to the FIG. 1, reference numeral 1 indicates one illustrative embodiment of a book rack of the present invention. Book rack 1 includes two side walls 3 and a rack 5 extending between the side walls. The side walls have a bottom edge 3*a*, a front edge 3*b*, a back edge 3*c* taller than the front edge, and a sloped top edge 3*d*. Preferably all the corners of the side walls 3 are rounded off, so that no sharp corners exist. The shape and sizing of the walls give the book rack stability and provide for easy access to books contained therein by toddlers.

As seen in FIGS. 7–10, the side walls 3 include a core 7 made of a light weight structural material. Core 7 is preferably made of a corrugated or honey-combed paperboard which may be resin treated to add further stiffness to the core. The core may also be made of materials such as styrofoam, foamed urethane, or other such materials. Core 7 has inner and outer surfaces 9 and 11, respectively, and an edge surface 13. The inner and outer surfaces 9 and 11 are covered with a coating or liner 15, which is glued or otherwise secured to the surfaces of the core. Coating 15 is preferably a formica coating or some other washable coating which may be easily cleaned. For example, a plastic could be used for the coating.

Figure 10:
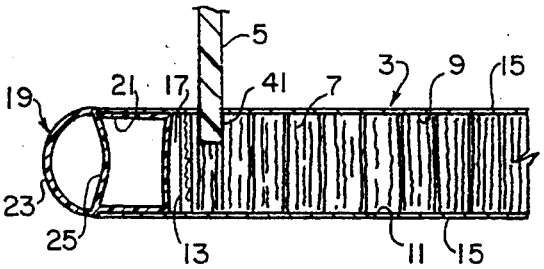
FIG. 10 is an enlarged sectional view of the wall construction taken along line 10—10 of FIG. 9.

As seen in FIG. 10, the coating extends beyond the edge 13 of core 7 to define a channel 17. An edge bead 19 is received in the channel to cover the core edge 13. In this manner, the core 7 is completely encased by the coatings 17 and the edge bead 19. Edge bead 19 includes a foot portion 21 which is received in channel 17 and a head or bead portion 23 which is exposed. The head portion preferably is semi-circular in cross-section, as seen in FIG. 10. The edge bead 19 is preferably hollow and has a wall 25 separating the foot portion from the bead portion. Bead 19 is preferably formed as an extruded plastic polymer, such as vinyl, or a hard or semi-hard rubber.

Figure 8:
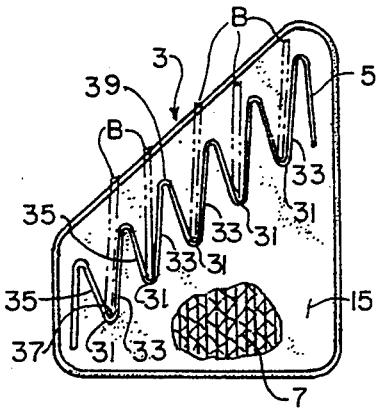
FIG. 8 is an elevational view of the side of the book rack with a rack secured thereto.
Figure 9:
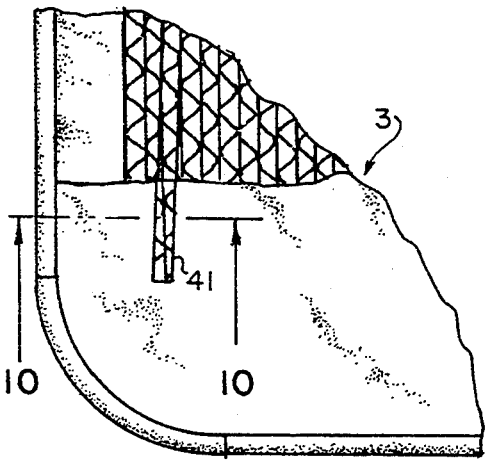
FIG. 9 is an enlarged sectional view of the side wall taken along line 9—9 of FIG. 7.

Rack 5 is formed from a single sheet of material, preferably a plastic or acrylic that is substantially clear. The sheet is formed as a wave, as seen in FIG. 8, which defines a plurality of valleys 31, in which books B can be placed. Each valley 31 has a back wall 33 against which books B can rest, and a front wall 35 which is of a sufficient height to prevent the books from falling forwardly out of the book rack 1. The fronts 33 and backs 31 of each valley are joined by the bottom 37 of the valley. The front 35 of one valley and the back 33 of its preceding valley are joined by the top or crest 39 of each wave. The rack 5 is formed so that each valley 31 is slightly higher and behind its preceding valley so that the books contained in each valley will be readily visible and easily reachable. As noted above, the rack 5 is preferable made of a clear or substantially transparent plastic. This enables the children to better see the front covers of the books B to recognize the books contained in book rack 1.

The side walls 3 each have a groove 41 formed on their inner surfaces. Groove 41 is shaped complementary to rack 5 and receives rack 5. To secure rack 5 to walls 3, a glue is placed in groove 41 and the rack is then inserted into the groove. In this manner, the rack is glued to the walls, to hold the book shelf together.

As can be appreciated, the construction of the book rack of the present invention provides a light weight, yet sturdy, book rack which can hold children's books in such a manner that the books are readily visible and accessible to children. The design of the walls 3 makes the book rack stable, so that it may not be easily overturned by children.

Variations may be apparent to those skilled in the art which are within the scope of the appended claims. The foregoing description is thus intended to be descriptive and not limiting.

We claim:

1. A book rack having two side walls, said side walls each including a core of lightweight structural material, inner and outer coatings covering an inner surface and an outer surface of said core, respectively, and an edge bead covering an edge of said core, said lightweight structural material being chosen from the group consisting of styrofoam, foamed urethane, corrugated paperboard, and honeycombed paperboard; and a rack means extending between said two side walls, said rack means comprising a single sheet of material formed generally as a wave defining a plurality of valleys, each said valley having a forward wall and a rear wall, said sheet being formed such that the a valley is positioned above and behind a preceding valley.

2. The book rack of claim 1 wherein said rack means sheet is made of plastic or acrylic.

3. The book rack of claim 2 wherein said rack means sheet is substantially transparent.

4. The book rack of claim 1 wherein said coatings comprise formica.

5. The book rack of claim 1 wherein said inner surfaces of said side walls define grooves shaped complementary to said rack means, said rack means being received in said grooves.

6. The book rack of claim 1 wherein said side wall coverings extend beyond said lightweight structural material to define a channel, said edge bead including a foot portion and an exposed bead portion, said foot portion being received in said channel.

7. The book rack of claim 6 wherein said edge bead comprises an extruded plastic or rubber.

8. The book rack of claim 7 wherein said edge bead is hollow.

9. The book rack of claim 8 wherein said edge bead has an inner wall separating said foot portion from said bead portion.

10. A book rack having two side walls, said side walls each comprising a core having an inner surface, an outer surface, and an edge, said core being made of a lightweight structural material;

inner and outer liners covering said core inner and outer surfaces, said liners being made from a hard washable material; and an edge bead covering said edge of said core; and a rack means extending between said two side walls, said rack means comprising a single sheet of a substantially transparent material; said sheet defining a plurality of valleys in which books can be placed, each said valley having a forward wall and a rear wall, said sheet being formed such that the a valley is positioned above and behind a preceding valley;

said inner surfaces of said side walls defining a groove shaped complementary to said rack means, said rack means being received in said groove.

11. The book rack of claim 10 wherein said lightweight structural material is chosen from the group consisting of styrofoam, foamed urethane, corrugated paperboard, and honeycombed paperboard.

12. The book rack of claim 10 wherein said rack means sheet is made of plastic or acrylic.

13. The book rack of claim 10 wherein said liners are chosen from a group consisting of formica or plastic.

14. The book rack of claim 10 wherein said side wall liners extend beyond said lightweight structural material to define a channel, said edge bead including a foot portion and an exposed bead portion, said foot portion being received in said channel.

15. The book rack of claim 14 wherein said edge bead comprises an extruded plastic or rubber.

16. The book rack of claim 15 wherein said edge bead is hollow.

17. The book rack of claim 16 wherein said edge bead has an inner wall separating said foot portion from said bead portion.

* * * * *